US010418727B1

(12) United States Patent
Wu

(10) Patent No.: US 10,418,727 B1
(45) Date of Patent: Sep. 17, 2019

(54) ROTATE-TO-OPEN CLAMPING UNIT AND CONNECTION DEVICE HAVING THE SAME

(71) Applicants: DINKLE ENTERPRISE CO., LTD., New Taipei (TW); DINKLE ELECTRIC MACHINERY (CHINA) CO., LTD., Kunshan, Jiangsu (CN)

(72) Inventor: Shang-Tsai Wu, New Taipei (TW)

(73) Assignees: DINKLE ENTERPRISE CO., LTD., New Taipei (TW); DINKLE ELECTRIC MACHINERY (CHINA) CO., LTD., Kunshan, Jiangsu (CN)

( * ) Notice: Subject to any disclaimer, the term of this patent is extended or adjusted under 35 U.S.C. 154(b) by 0 days.

(21) Appl. No.: 16/191,437

(22) Filed: Nov. 15, 2018

(51) Int. Cl.
*H01R 4/26* (2006.01)
*H01R 4/48* (2006.01)
*H01R 9/24* (2006.01)

(52) U.S. Cl.
CPC ..... *H01R 4/4827* (2013.01); *H01R 9/2416* (2013.01)

(58) Field of Classification Search
CPC ..... H01R 4/4836
USPC ..... 439/441
See application file for complete search history.

(56) References Cited

U.S. PATENT DOCUMENTS 7,104,833 B2 * 9/2006 Oesterhaus ..... H01R 4/4836 439/441
8,262,422 B1 * 9/2012 Chiang ..... H01R 4/4836 439/441
8,388,387 B2 * 3/2013 Koellmann ..... H01R 4/4845 439/729
8,444,443 B2 * 5/2013 Schafmeister ..... H01R 4/4836 439/441
8,480,424 B2 * 7/2013 Koellmann ..... H01R 4/4845 439/358
8,794,994 B2 * 8/2014 Kollmann ..... H01R 4/4836 439/441
9,209,530 B2 * 12/2015 Gassauer ..... H01R 4/4836
9,466,895 B2 * 10/2016 Kollmann ..... H01R 4/4836
9,472,871 B2 * 10/2016 Lin ..... H01R 12/53
9,548,564 B2 * 1/2017 Wu ..... H01R 4/4836
10,033,119 B2 * 7/2018 Koellmann ..... H01R 4/4836
10,164,349 B2 * 12/2018 Koellmann ..... H01R 4/4836
10,230,179 B2 * 3/2019 Wilinski ..... H01R 4/4836
10,236,597 B2 * 3/2019 Meyer ..... H01R 4/4809
10,340,613 B2 * 7/2019 Geske ..... H01R 4/4845
2019/0190168 A1 * 6/2019 Witte ..... H01R 4/4845

* cited by examiner

*Primary Examiner* — Neil Abrams
(74) *Attorney, Agent, or Firm* — Chung-Ming Shih; HLDS IPR Services

(57) ABSTRACT

A rotate-to-open clamping unit and a connection device having the same are disclosed. The connection device includes a housing and plural clamping unit disposed in the housing. The clamping unit includes an elastic member and a rotate-to-open member. The elastic member is leaned by a conductive terminal and has a moveable elastic arm and a pivotal connection space. The rotate-to-open member has an extending arm formed with an extending distal end pivoted in the pivotal connection space. The rotate-to-open member is rotated with the extending distal end served as an axis, the rotate-to-open member in a rotating status is able to drive the moveable elastic arm to be displaced so as to be opened, so that a conductive member can be elastically clamped or released between the moveable elastic arm and the conductive terminal.

24 Claims, 9 Drawing Sheets

ROTATE-TO-OPEN CLAMPING UNIT AND CONNECTION DEVICE HAVING THE SAME

BACKGROUND OF THE INVENTION

Field of the Invention

The present invention relates to a clamping unit, especially to a rotate-to-open clamping unit and a connection device having the same.

Description of Related Art

A conventional clamping unit is mainly used for allowing a conductive member inserted by a user to be clamped with an existed conductive terminal so as to be electrically conducted.

The conventional clamping unit includes a clamping spring and an opening button. The conductive terminal is in contact with the clamping spring. The clamping spring has a tongue piece. The opening button is longitudinally disposed on the clamping spring. When the conductive member is inserted, the clamping unit is served to clamp the conductive member and the conductive terminal so to be electrically conducted.

However, the clamping spring and the opening button of the conventional clamping unit are individually disposed, and a movement displacing path of the tongue piece being pressed by the opening button for the purpose of opening is a linear path, which is different from a passive displacing path of the tongue piece itself, so that the stability of the opening button being displaced relative to the clamping spring is poor.

Moreover, the opening button is used for driving the tongue piece to be displaced between two support arms, thus the two support arms may be close to each other due to no limitation provided, and an operation of inserting or removing the conductive member would be interfered, thereby causing a problem of the conductive member being difficultly or even unable to be inserted or removed.

SUMMARY OF THE INVENTION

The present invention is to provide a rotate-to-open clamping unit and a connection device having the same, which has an advantage of providing a better stability to a rotate-to-open member while being displaced relative to an elastic member with a means of being opened via rotations.

Accordingly, the present invention provides a rotate-to-open clamping unit, which is used for enabling a conductive member to be electrically connected to a conductive terminal, and includes: an elastic member, having a moveable elastic arm, a leaning connection arm and a pivotal connection space formed through a bending process, wherein the conductive terminal is leaned against the leaning connection arm; and a rotate-to-open member, having an opening main body and at least one extending arm extended from the opening main body, wherein the at least one extending arm is formed with an extending distal end capable of protruding into the pivotal connection space so as to allow the extending distal end to be pivoted with the pivotal connection space; wherein, the rotate-to-open member is rotated relative to the elastic member with the extending distal end served as an axis, the rotate-to-open member in a rotating status is able to drive the moveable elastic arm to be displaced relative to the elastic member so as to be opened, so that the conductive member is able to be elastically clamped or released between the moveable elastic arm and the conductive terminal.

Accordingly, the present invention provides a connection device having a rotate-to-open clamping unit, which is used for enabling a conductive member to be electrically connected to a conductive terminal, and includes: a housing; and at least one clamping unit disposed in the housing; wherein, the clamping unit includes: an elastic member, fastened in the housing and having a moveable elastic arm, a leaning connection arm and a pivotal connection space formed through a bending process, the conductive terminal is leaned against the leaning connection arm; and a rotate-to-open member, having an opening main body and at least one extending arm extended from the opening main body, the at least one extending arm is formed with an extending distal end capable of protruding into the pivotal connection space so as to allow the extending distal end to be pivoted with the pivotal connection space; wherein, the rotate-to-open member of the clamping unit is rotated relative to the elastic member with the extending distal end served as an axis, the rotate-to-open member in a rotating status is able to drive the moveable elastic arm to be displaced relative to the elastic member so as to be opened, so that the conductive member is able to be elastically clamped or released between the moveable elastic arm and the conductive terminal.

In comparison with related art, the present invention has advantageous features as follows. The rotate-to-open member is provided with a better stability during the operation of the rotate-to-open member being rotated relative to the elastic member.

DETAILED DESCRIPTION OF THE INVENTION

A preferred embodiment of the present invention will be described with reference to the drawings.

Figure 1:
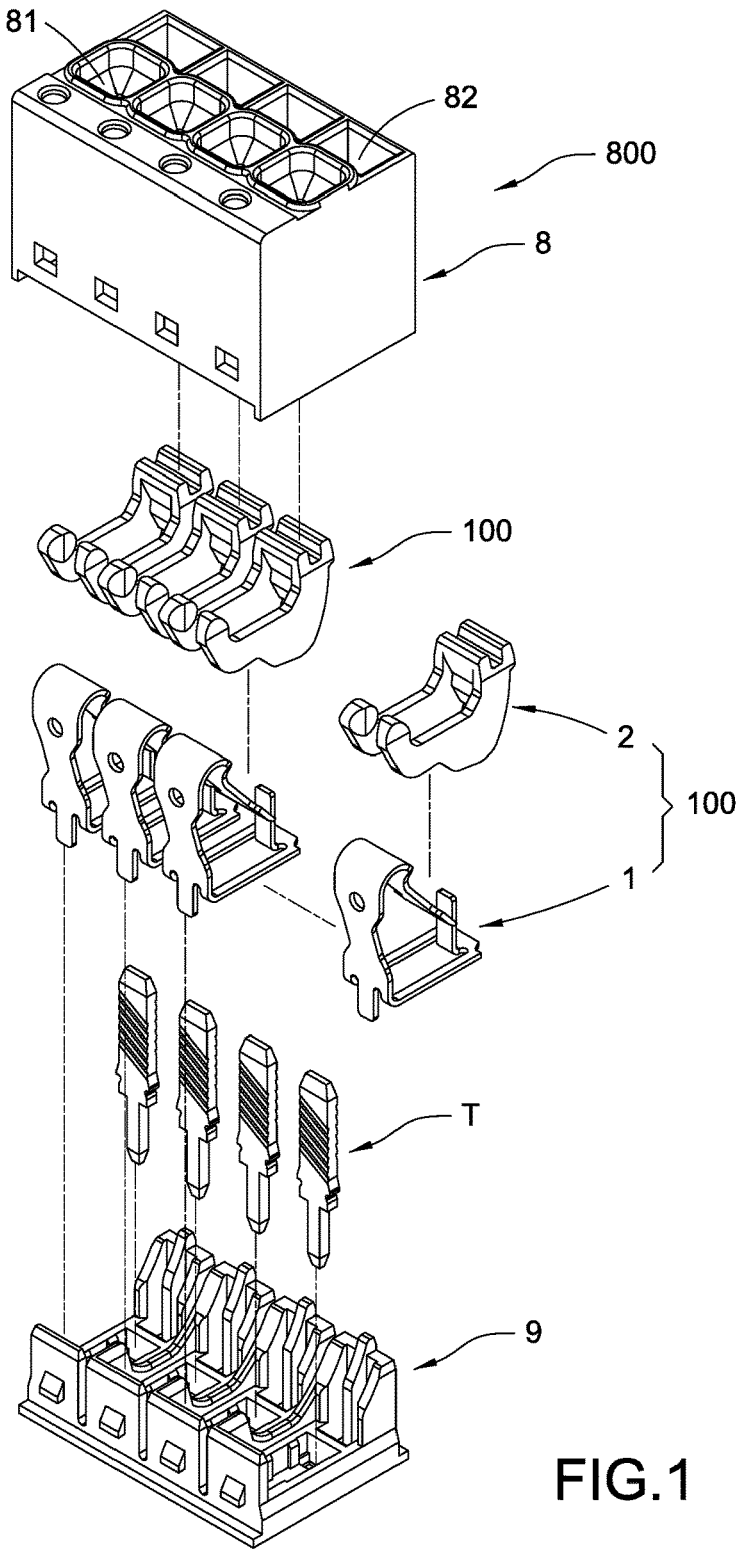
FIG. 1 is a perspective exploded view showing a connection device according to the present invention.
Figure 7:
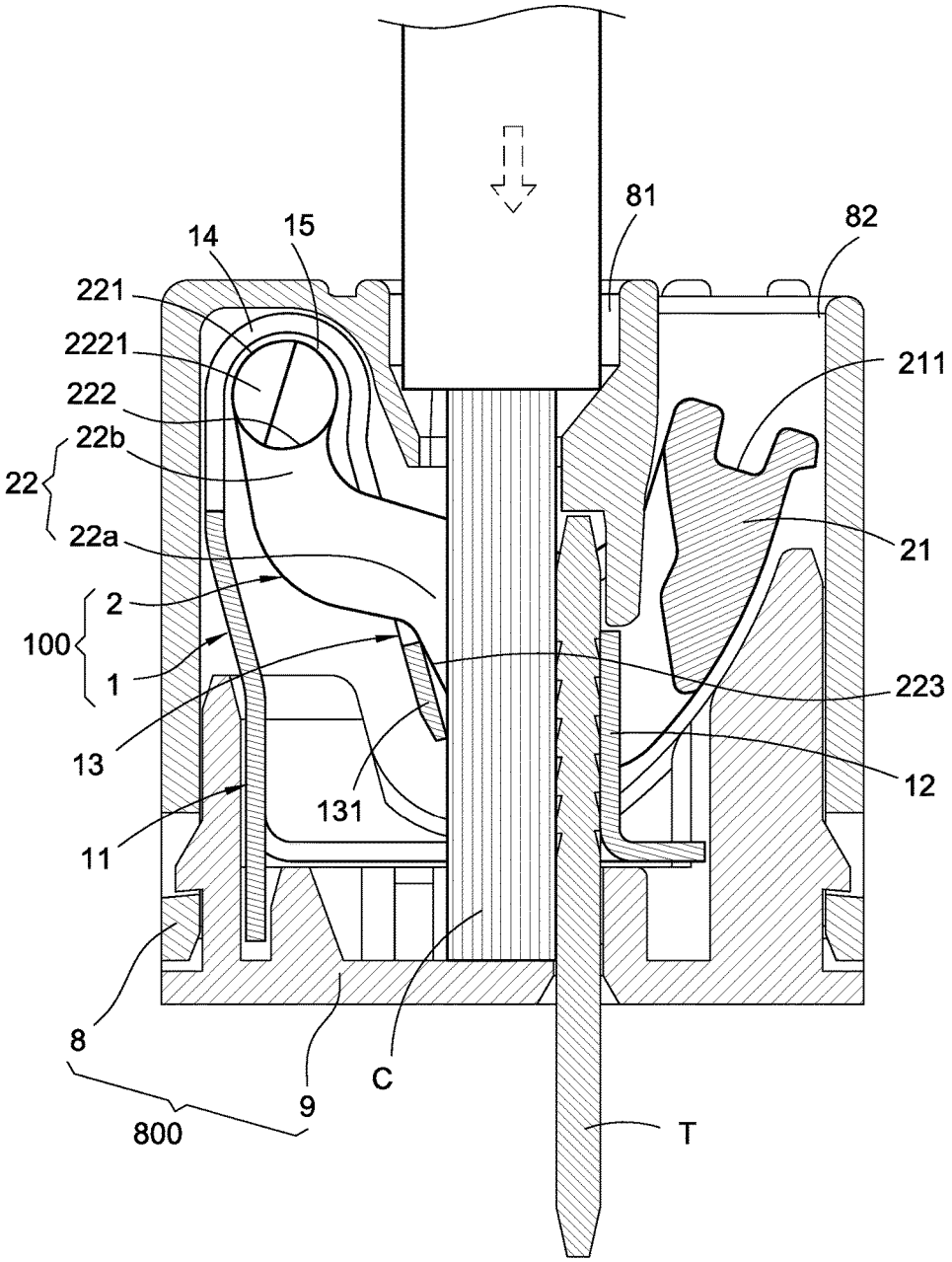
FIG. 7 is a cross sectional view of FIG. 6 wherein the conductive member being inserted according to the present invention.

Please refer to FIG. 1, a rotate-to-open clamping unit and a connection device having the same are disclosed in the present invention. The connection device includes a housing 800 and at least one clamping unit 100 disposed in the housing 800. According to this embodiment, there is one or a plurality of the clamping units 100 adopted in the present invention. The clamping unit 100 is used for clamping a conductive member C (as shown in FIG. 7) for being electrically connected to a conductive terminal T. Wherein, the clamping unit 100 includes an elastic member 1 and a rotate-to-open member 2.

Please refer from FIG. 1 to FIG. 6, the elastic member 1 basically has a moveable elastic arm 13, a leaning connection arm 12 and a pivotal connection space 15 formed through a bending process. Preferably, the elastic member 1 further has a main body 11 and a bending part 14.

Figure 4:
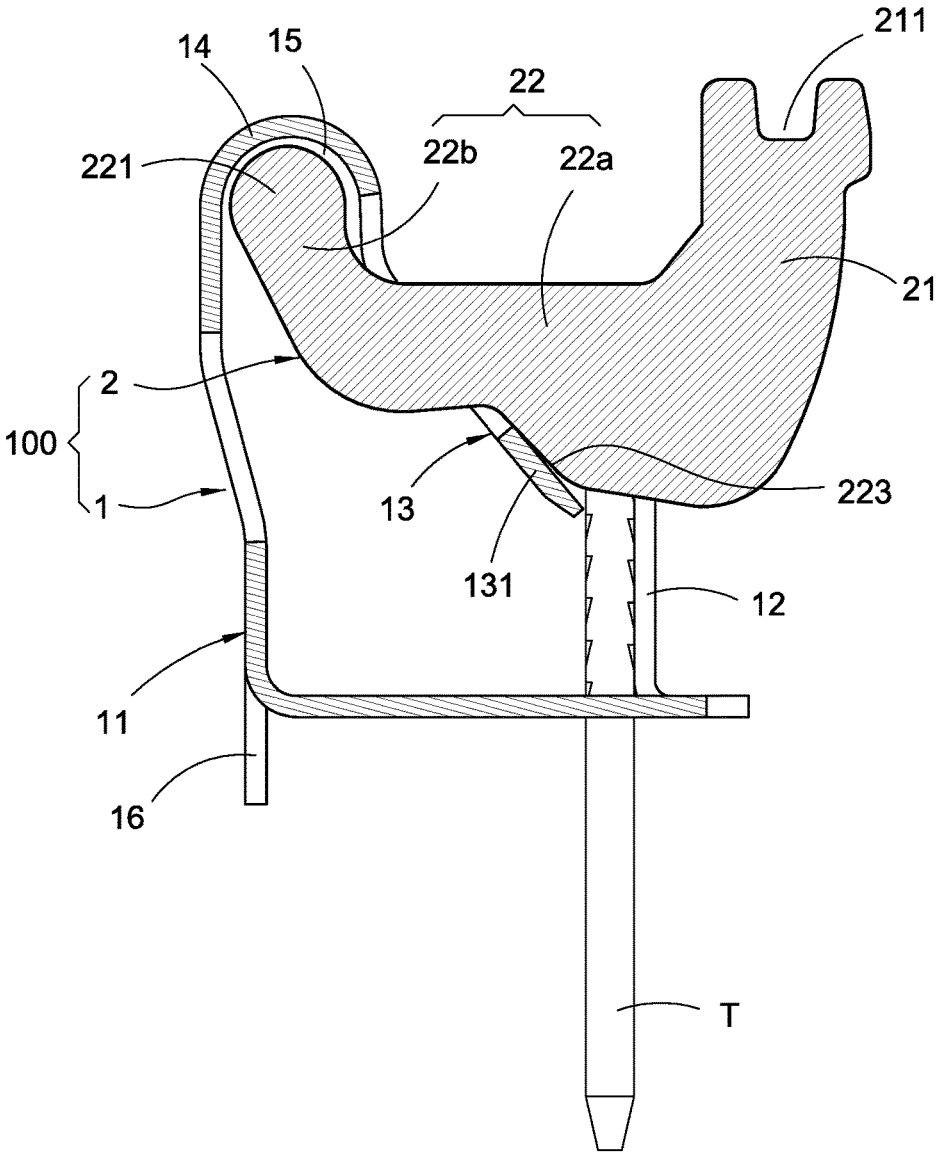
FIG. 4 is a cross sectional view showing the assembly of the clamping unit according to the present invention.
Figure 5:
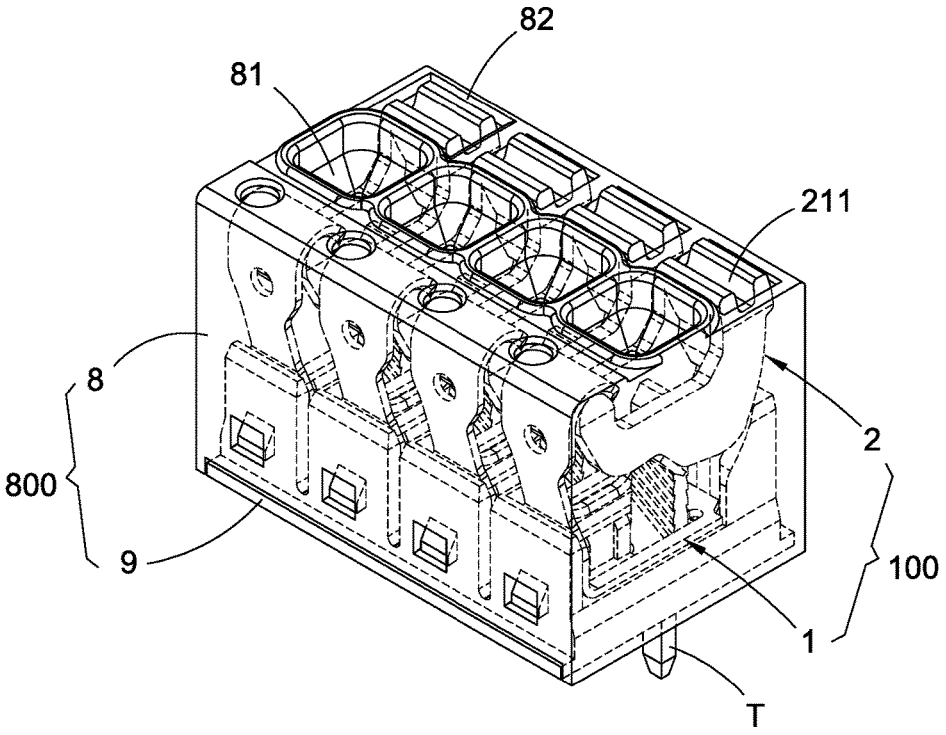
FIG. 5 is a perspective view showing the assembly of FIG. 1 according to the present invention.

The main body 11 can be formed as an L-shaped member as shown in figures. The leaning connection arm 12 is connected to one end of the main body 11; the bending part 14 is connected between another end of the main body 11 and the moveable elastic arm 13, and the pivotal connection space 15 is defined as a space formed through the bending part 14 being treated with the bending process, so that the moveable elastic arm 13 is able to be elastically displaced relative to the main body 11 with the bending part 14 served as an axis. As shown in FIG. 4, the conductive terminal T is leaned against the leaning connection arm 12; and substantially speaking, the conductive terminal T is elastically clamped between the moveable elastic arm 13 and the leaning connection arm 12 via an elastic force provided by the moveable elastic arm 13.

As shown from FIG. 1 to FIG. 6, the rotate-to-open member 2 has an opening main body 21 and at least one extending arm 22 extended from the opening main body 21. According to this embodiment, there is one or a plurality of the extending arms 22 adopted in the present invention, and what shall be addressed is that the scope of the present invention is not limited by the amount of the extending arms 22. In this embodiment, there are two extending arms 22, which are oppositely arranged with an interval, adopted in the present invention for the purpose of providing a clear disclosure.

A passive opening part 211 is formed on a top end of the opening main body 21. The structure of the passive opening part 211 is not specified according to the present invention; in this embodiment, a screwdriver groove as shown in figures is adopted for the purpose of providing a clear disclosure, so that a user can use a hand tool, for example a screwdriver, to inset into the passive opening part 211 for enabling the rotate-to-open member 2 to be operated.

One end of the extending arm 22 is connected to one side defined at a lower portion of the opening main body 21, another end thereof is extended towards a direction away from the opening main body 21 and formed with an extending distal end 221, and the extending distal end 221 of the extending arm 22 is able to protruded into the pivotal connection space 15 so as to allow the extending distal end 221 to be pivoted with the pivotal connection space 15.

Figure 6:
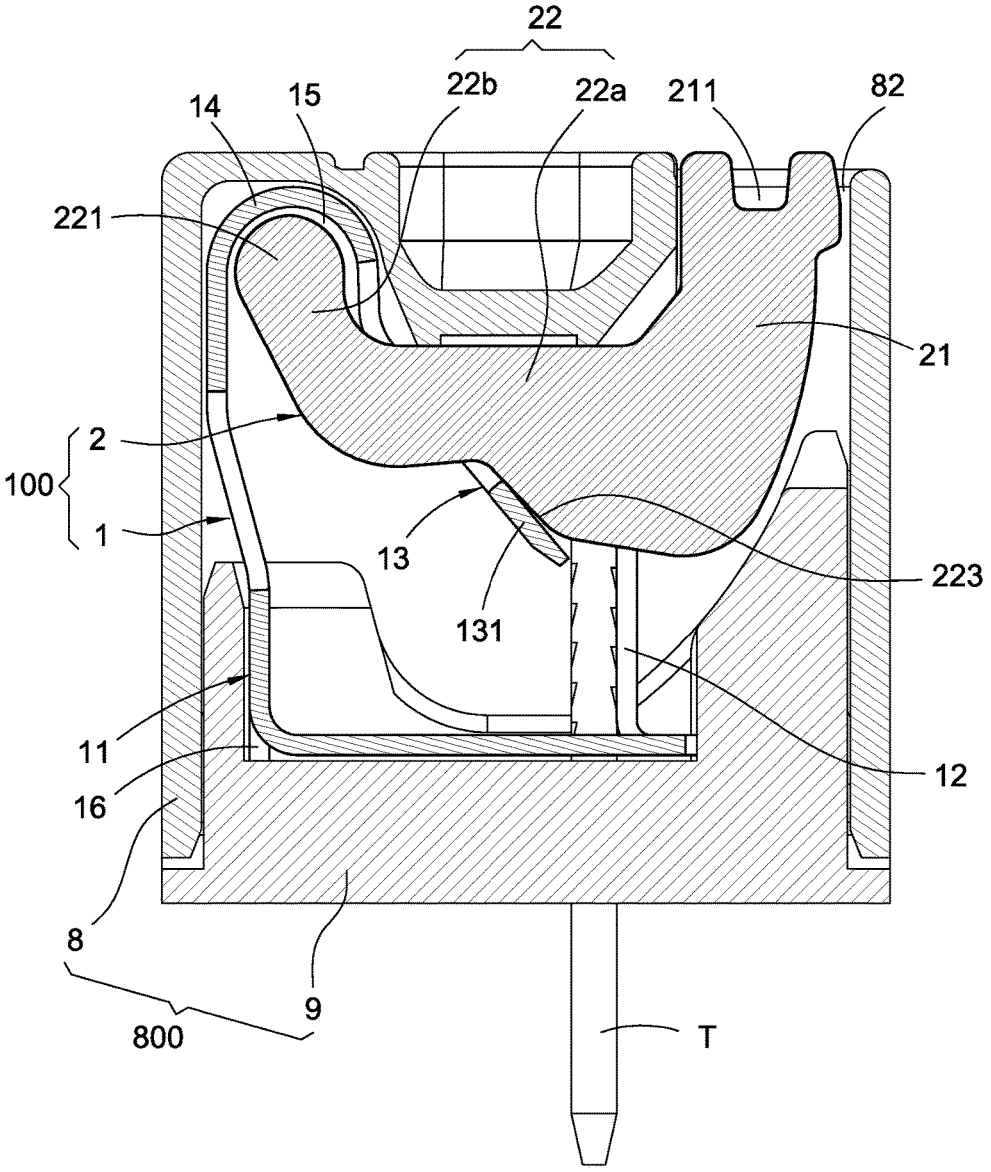
FIG. 6 is a cross sectional view of FIG. 5 according to the present invention.
Figure 8:
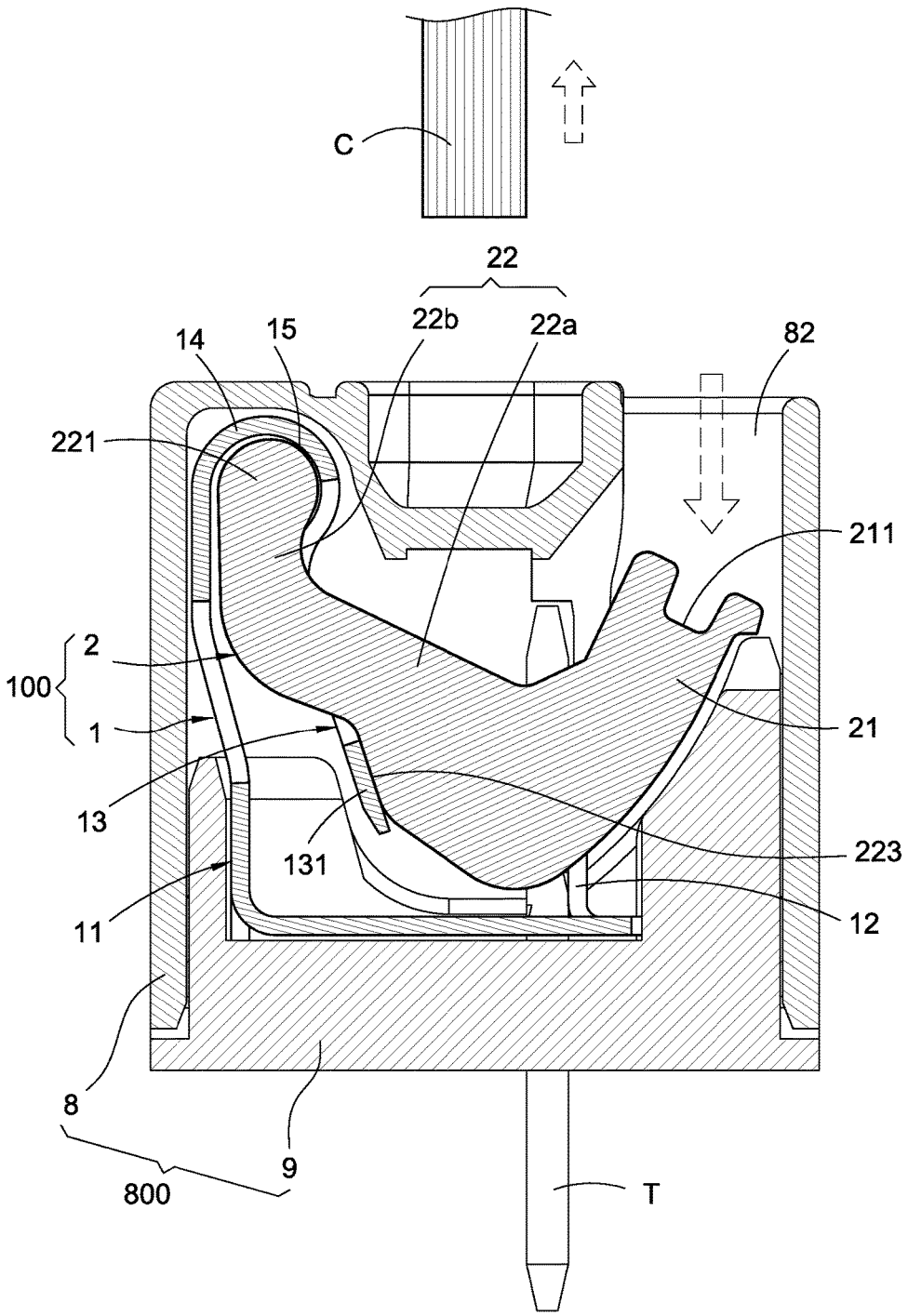
FIG. 8 is a cross sectional view of FIG. 7 wherein the conductive member being released according to the present invention.

As shown from FIG. 6 to FIG. 8, when the passive opening part 211 of the rotate-to-open member 2 is pressed and rotated by the user, the rotate-to-open member 2 is able to be rotated relative to the elastic member 1 with the extending distal end 221 served as an axis, so that the rotate-to-open member 2 in a rotating status can drive the moveable elastic arm 13 to be displaced relative to the leaning connection arm 12 so as to finish an opening operation, and the conductive member C can be elastically clamped between the moveable elastic arm 13 and the conductive terminal T after being inserted (as shown in FIG. 7), or the conductive member C is allowed to be released from the moveable elastic arm 13 and the conductive terminal T (as shown in FIG. 8). Of course, when the conductive member C is inserted, the insertion process can be done without pressing the rotate-to-open member 2, because the conductive member C itself is able to force the moveable elastic arm 13 to be displaced during the insertion operation.

Figure 2:
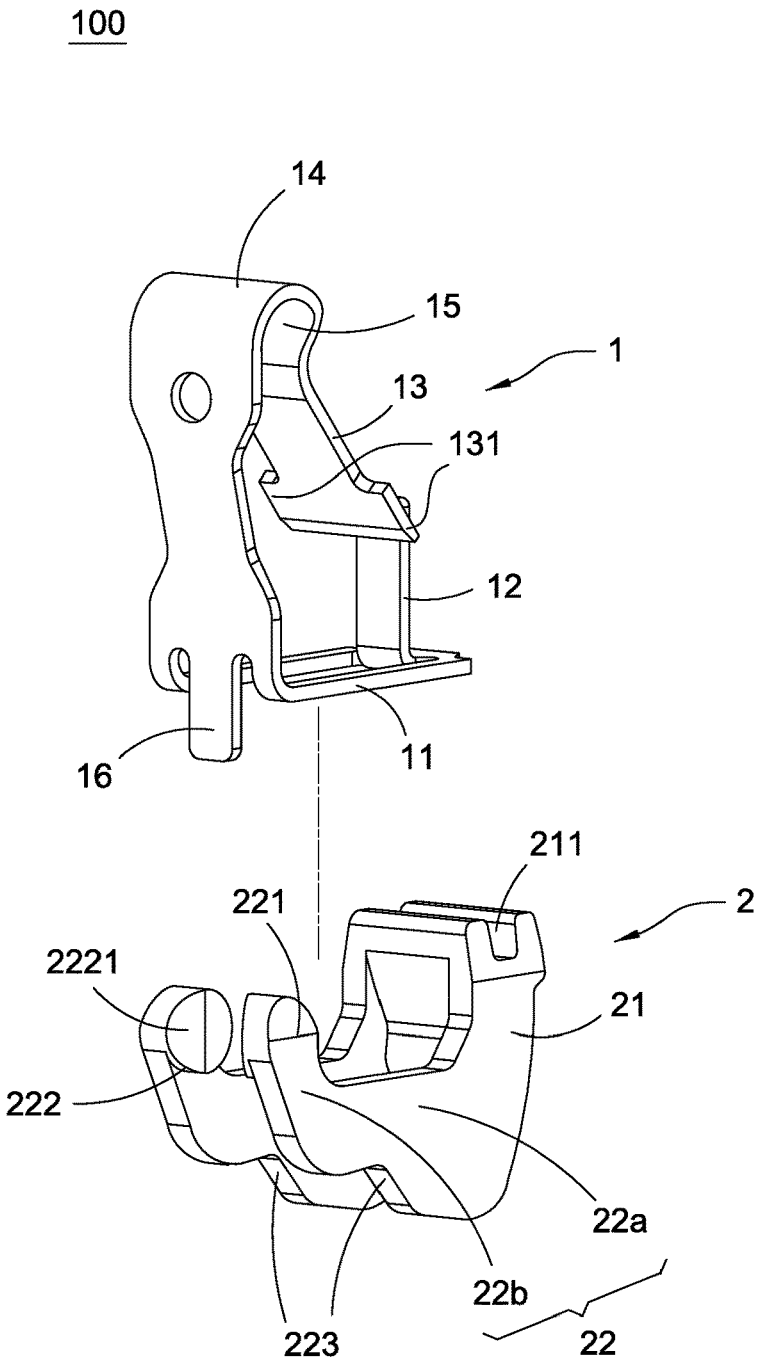
FIG. 2 is a perspective exploded view showing the clamping unit of the connection device according to the present invention.
Figure 3:
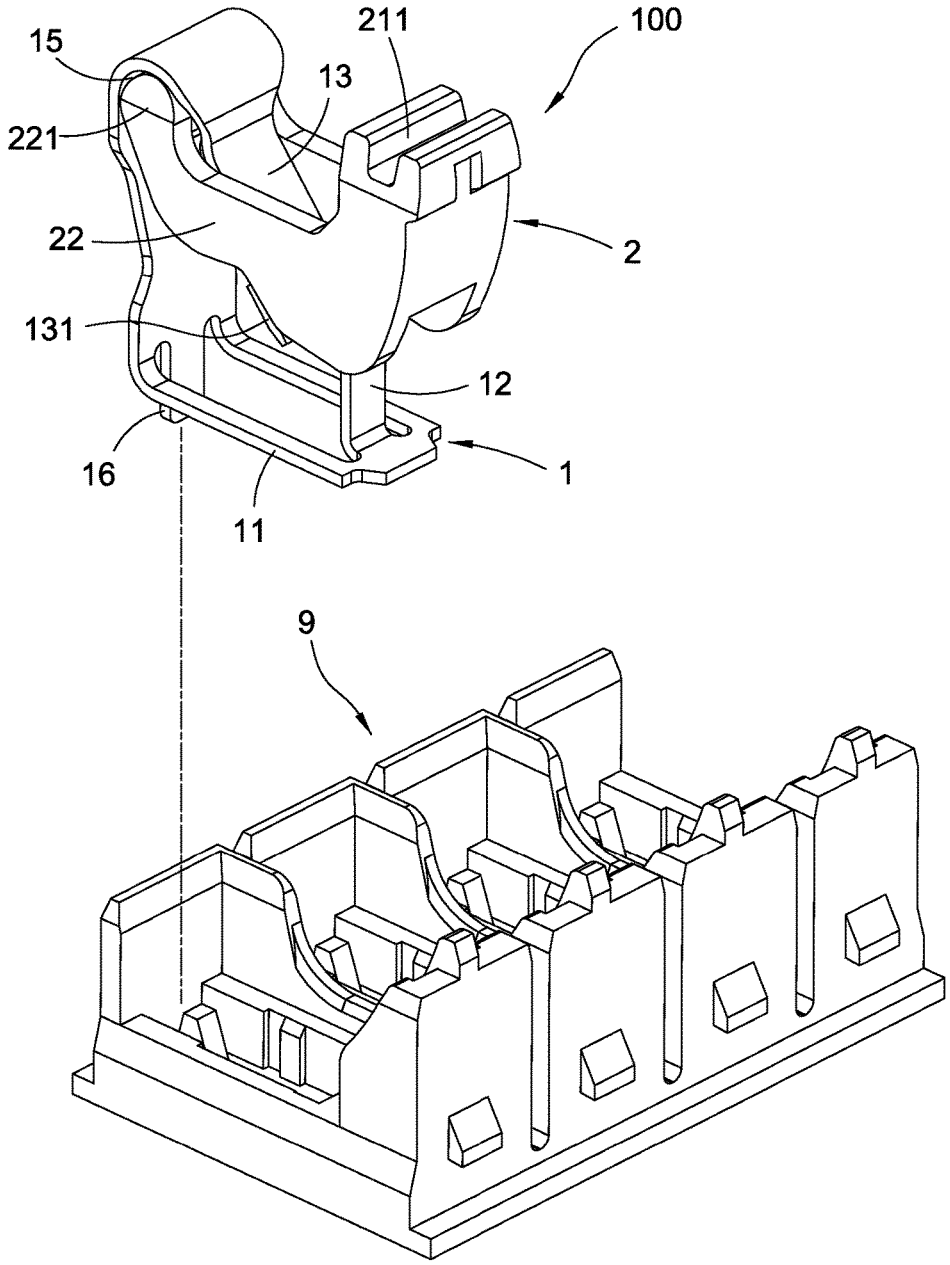
FIG. 3 is a perspective exploded view showing the clamping unit and the base according to the present invention.

As shown from FIG. 2 to FIG. 4, substantially speaking, the extending arm 22 has a first segment 22*a* and a second segment 22*b* which are formed in a status of the top end of the first segment 22*a* being connected to the tail end of the second segment 22*b* or vice versa. The opening main body 21 and the second segment 22*b* are uprightly connected (including vertically connected or crossly connected in various angles) to two ends of the first segment 22*a*, and the opening main body 21 and the second segment 22*b* are arranged at the same side of the first segment 22*a*, so that the rotate-to-open member 2 is formed in a U-like shape while being viewed from a side angle (as shown in FIG. 4). As shown in FIG. 4, the first segment 22*a* is transversally extended from one side of the opening main body 21 which is longitudinally arranged, and the second segment 22*b* is obliquely connected to the first segment 22*a*.

Preferably, the moveable elastic arm 13 further has a driven part 131, according to this embodiment, there is one more a plurality of the driven parts 131 adopted in the present invention; in this embodiment, there are two driven parts 131 adopted for the purpose of providing a clear disclosure. The driven parts 131 can be formed as a lug and protruded from two opposite sides of the moveable elastic arm 13. The driven part 131 is pressed and connected to the rotate-to-open member 2, thereby enabling the rotate-to-open member 2 to be supported by the driven part 131, and the driven part 131 can be driven, while the rotate-to-open member 2 is rotated, to enable the moveable elastic arm 13 to be displaced relative to the elastic member 1.

Moreover, the extending arm 22 further has a driving part 223, the driving part 223 is located between the passive opening part 211 and the extending distal end 221, so that the rotate-to-open member 2 can be supported through the driven part 131 of the moveable elastic arm 13 being pressed and connected to the driving part 223.

The extending arms 22 are arranged to both crossly pass the moveable elastic arm 13 (as shown in FIG. 4), and the extending arms 22 are correspondingly served to clamp two opposite sides of the moveable elastic arm 13, in other words the width of the moveable elastic arm 13 is limited between the extending arms 22, thereby preventing the extending arms 22 from being close to each other.

As shown in FIG. 2, a convex shaft 222 penetrating into the pivotal connection space 15 is protruded from the extending distal end 211, so that the convex shaft 222 is able to be coaxially pivoted with the pivotal connection space 15 formed via the bending part 14. Moreover, opposite inner surfaces of the convex shafts 222 are formed with a trimmed guiding angle 2221, so that the convex shaft 222 can be guided and assisted to protrude into the pivotal connection space 15 via the trimmed guiding angle 2221.

As shown in FIG. 1, FIG. 4, FIG. 5 and FIG. 6, according to this embodiment, the connection device includes the housing 800 and the plural clamping units 100 disposed in the housing 800.

The housing 800 includes a base 9 and a cover member 8 covering the base 9. The cover member 8 is formed with a plurality of insertion holes 81 and a plurality of openings 82.

The elastic member 1 of the clamping unit 100 is fastened on the base 9, the main body 11 of the elastic member 1 is preferably provided with an insertion arm 16, so that the elastic member 1 can be fastened in the housing 800 through the insertion arm 16 being inserted in the base 9. The conductive terminal T is also inserted in the base 9.

The extending distal end 221 of the rotate-to-open member 2 is protruded into the pivotal connection space 15 of the elastic member 1 so as to be pivoted with the pivotal connection space 15; the rotate-to-open member 2 is supported through the driven part 131 of the moveable elastic arm 13 being pressed and connected to the driving part 223; and the extending arms of the rotate-to-open member 2 are prevented from being close to each other due to the width limitation of the moveable elastic arm 13 of the elastic member 1.

When in use, the conductive member C is inserted or removed between the extending arms of the rotate-to-open member 2 via the insertion hole 81. When the moveable elastic arm 13 of the elastic member 1 is desired to be opened, a hand tool, for example a screwdriver, is served to insert into the passive opening part 211 via the opening 82 for enabling the rotate-to-open member 2 to be rotated.

Figure 9:
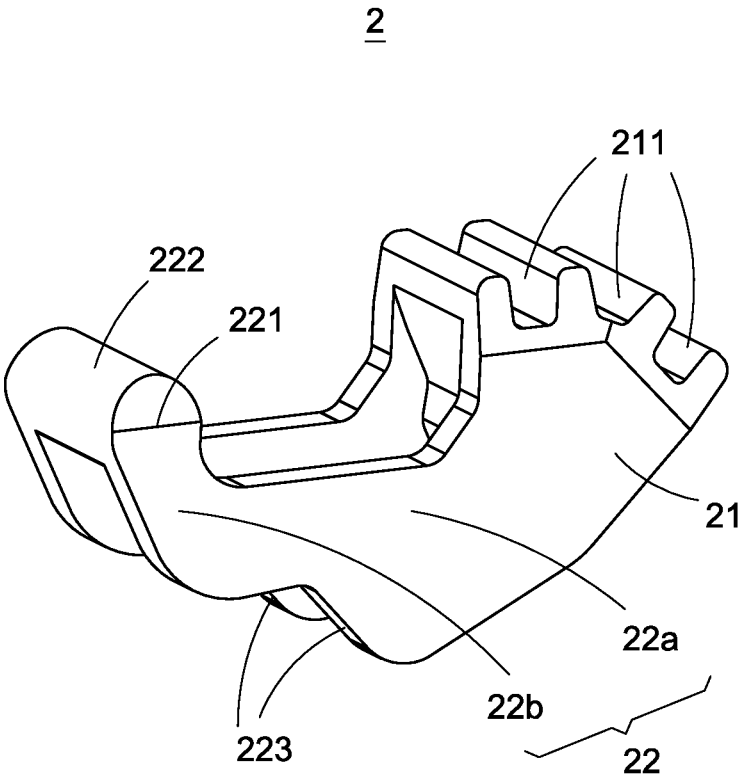
FIG. 9 is a perspective view showing another type of the rotate-to-open member of the connection device according to the present invention.

Please refer to FIG. 9, which discloses another type of the rotate-to-open member 2, the configuration of the another type of the rotate-to-open member 2 is mostly the same as the above-mentioned rotate-to-open member 2, and the difference between the two is the amount of passive opening part 211 and the structure of the convex shaft 222. Details are provided as follows. As shown in FIG. 9, a top end of the opening main body 21 of the another type of the rotate-to-open member 2 is formed with two or more of the passive opening parts 211 so as to be suitable to be applied in the different housings 800 having different model numbers (or manufactured by different companies), in other words the passive opening part 211 is able to be exposed in the opening 82 of the housing 800 formed in a different status; moreover, there is one convex shaft 222, capable of being pivoted in the pivotal connection space 15, shared by the extending distal ends 221, so that the convex shaft 222 can be coaxially pivoted with the pivotal connection space 15 formed via the bending part 14.

Based on what has been disclosed above, advantages achieved by the present invention are as follows: the extending distal end 221 of the extending arm 22 of the rotate-to-open member 2 is coaxially pivoted in the pivotal connection space 15 of the elastic member 1, so that the moveable elastic arm 13 can be driven to be opened relative to the leaning connection arm 12 while the rotate-to-open member 2 is rotated with a means of being opened via rotations, and the elastic member 1 and the rotate-to-open member 2 are pivoted with each other instead of being individually disposed (a rotation driving path of the rotate-to-open member 2 can be the same as a passive displacing path of the moveable elastic arm 13), thus the rotate-to-open member 2 is provided with a better stability while being rotated relative to the elastic member 1. In addition, the rotate-to-open member 2 can be supported through the driven part 131 of the moveable elastic arm 13 being pressed and connected to the driving part 223, thereby being provided with a better stability.

Moreover, other advantages achieved by the present invention are as follows: the extending arms 22 of the rotate-to-open member 2 are crossly arranged with the moveable elastic arm 13, so that the extending arms 22 can be prevented from being close to each other due to the width limitation of the moveable elastic arm 13, and a space formed between the extending arms for allowing the conductive member C to be inserted or removed is protected from being decreased, so that the operation of inserting or removing the conductive member C is not interfered. Moreover, a bottom edge of the extending arm 22 is able to be arranged to be adjacent to a thickness side (not shown in figures) of the driven part 13, thereby further enhancing the stability effect.

Although the present invention has been described with reference to the foregoing preferred embodiment, it will be understood that the invention is not limited to the details thereof. Various equivalent variations and modifications can still occur to those skilled in this art in view of the teachings of the present invention. Thus, all such variations and equivalent modifications are also embraced within the scope of the invention as defined in the appended claims.

What is claimed is:

1. A rotate-to-open clamping unit, used for enabling a conductive member to be electrically connected to a conductive terminal, and including:

an elastic member, having a moveable elastic arm, a leaning connection arm and a pivotal connection space formed through a bending process, wherein the conductive terminal is leaned against the leaning connection arm; and a rotate-to-open member, having an opening main body and at least one extending arm extended from the opening main body, wherein the at least one extending arm is formed with an extending distal end capable of protruding into the pivotal connection space so as to allow the extending distal end to be pivoted with the pivotal connection spacer;

wherein, the rotate-to-open member is rotated relative to the elastic member with the extending distal end served as an axis, the rotate-to-open member in a rotating status is able to drive the moveable elastic arm to be displaced relative to the elastic member so as to be opened, so that the conductive member is able to be elastically clamped or released between the moveable elastic arm and the conductive terminal.

2. The rotate-to-open clamping unit according to claim 1, wherein the moveable elastic arm has at least one driven part, the at least one driven part is pressed and connected to the rotate-to-open member, thereby enabling the rotate-to-open member to be supported by the at least one driven part, and the rotate-to-open member is able to drive the moveable elastic arm to be displaced relative to the elastic member via the at least one driven part.

3. The rotate-to-open clamping unit according to claim 2, wherein there are a pair of the extending arms and a pair of the driven parts, the extending arm has a driving part and the extending distal end, the driven part is protruded from the moveable elastic arm, and pressed and connected to the driving part.

4. The rotate-to-open clamping unit according to claim 1, wherein the opening main body has at least one passive opening part, the rotate-to-open member is formed in a contacting status between the at least one passive opening part and the extending distal end and has at least one driving part served to drive the moveable elastic arm to be displaced.

5. The rotate-to-open clamping unit according to claim 1, wherein the at least one extending arm has a first segment and a second segment, the opening main body and the second segment are uprightly connected to two ends of the first segment, and the opening main body and the second segment are arranged at the same side of the first segment.

6. The rotate-to-open clamping unit according to claim 5, wherein a bottom end of the opening main body is connected to the end of the first segment, and a top end of the opening main body is formed with at least one passive opening part.

7. The rotate-to-open clamping unit according to claim 1, wherein there are a pair of the extending arms, the extending arm is formed with the extending distal end, and a convex shaft penetrating into the pivotal connection space for being coaxially pivoted with pivotal connection space is protruded from the extending distal end.

8. The rotate-to-open clamping unit according to claim 7, wherein opposite inner surfaces of the convex shafts are formed with a trimmed guiding angle, so that the convex shaft is able to be guided to protrude into the pivotal connection space via the trimmed guiding angle.

9. The rotate-to-open clamping unit according to claim 1, wherein there are a pair of the extending arms, the pair of extending arms arranged in parallel and spaced with an interval are crossly arranged with the moveable elastic arm, and the pair of extending arms are correspondingly served to clamp two opposite sides of the moveable elastic arm.

10. The rotate-to-open clamping unit according to claim 1, wherein there are a pair of the extending arms, the extending arm is formed with the extending distal end, and a convex shaft, pivoted in the pivotal connection space for being coaxially pivoted, is formed and shared by the extending distal ends.

11. The rotate-to-open clamping unit according to claim 1, wherein the elastic member further has a main body and a bending part, the leaning connection arm is connected to one end of the main body, the bending part is connected between another end of the main body and the moveable elastic arm, and the pivotal connection space is defined as a space formed through the bending part being treated with a bending process.

12. A connection device having a rotate-to-open clamping unit, used for enabling at least one conductive member to be electrically connected to at least one conductive terminal, and including:

a housing; and at least one clamping unit, disposed in the housing, and including:

an elastic member, fastened in the housing and having a moveable elastic arm, a leaning connection arm and a pivotal connection space formed through a bending process, wherein the conductive terminal is leaned against the leaning connection arm; and a rotate-to-open member, having an opening main body and at least one extending arm extended from the opening main body, wherein the at least one extending arm is formed with an extending distal end capable of protruding into the pivotal connection space so as to allow the extending distal end to be pivoted with the pivotal connection space;

wherein, the rotate-to-open member of the clamping unit is rotated relative to the elastic member with the extending distal end served as an axis, the rotate-to-open member in a rotating status is able to drive the moveable elastic arm to be displaced relative to the elastic member so as to be opened, so that the conductive member is able to be elastically clamped or released between the moveable elastic arm and the conductive terminal.

13. The connection device having the rotate-to-open clamping unit according to claim 12, wherein the elastic member of the clamping unit further has an insertion arm, and the insertion arm and the conductive terminal are inserted in the housing.

14. The connection device having the rotate-to-open clamping unit according to claim 12, wherein there are a plurality of the clamping units disposed in the housing.

15. The connection device having the rotate-to-open clamping unit according to claim 12, wherein the moveable elastic arm has at least one driven part, the at least one driven part is pressed and connected to the rotate-to-open member, thereby enabling the rotate-to-open member to be supported by the at least one driven part, and the rotate-to-open member is able to drive the moveable elastic arm to be displaced relative to the elastic member via the at least one driven part.

16. The connection device having the rotate-to-open clamping unit according to claim 15, wherein there are a pair of the extending arms and a pair of the driven parts, the extending arm has a driving part and the extending distal end, the driven part is protruded from the moveable elastic arm, and pressed and connected to the driving part.

17. The connection device having the rotate-to-open clamping unit according to claim 12, wherein the opening main body has at least one passive opening part, the rotate-to-open member is formed in a contacting status between the at least one passive opening part and the extending distal end and has at least one driving part served to drive the moveable elastic arm to be displaced.

18. The connection device having the rotate-to-open clamping unit according to claim 12, wherein the at least one extending arm has a first segment and a second segment, the opening main body and the second segment are uprightly connected to two ends of the first segment, and the opening main body and the second segment are arranged at the same side of the first segment.

19. The connection device having the rotate-to-open clamping unit according to claim 18, wherein a bottom end of the opening main body is connected to the end of the first segment, and a top end of the opening main body is formed with at least one passive opening part.

20. The connection device having the rotate-to-open clamping unit according to claim 12, wherein there are a pair of the extending arms, the extending arm is formed with the extending distal end, and a convex shaft penetrating into the pivotal connection space for being coaxially pivoted with the pivotal connection space is protruded from the extending distal end.

21. The connection device having the rotate-to-open clamping unit according to claim 20, wherein opposite inner surfaces of the convex shafts are formed with a trimmed guiding angle, so that the convex shaft is able to be guided to protrude into the pivotal connection space via the trimmed guiding angle.

22. The connection device having the rotate-to-open clamping unit according to claim 12, wherein there are a pair of the extending arms, the pair of extending arms arranged in parallel and spaced with an interval are crossly arranged with the moveable elastic arm, and the pair of extending arms are correspondingly served to clamp two opposite sides of the moveable elastic arm.

23. The connection device having the rotate-to-open clamping unit according to claim 12, wherein there are a pair of the extending arms, the extending arm is formed with the extending distal end, and a convex shaft, pivoted in the pivotal connection space for being coaxially pivoted, is formed and shared by the extending distal ends.

24. The connection device having the rotate-to-open clamping unit according to claim 12, wherein the elastic member further has a main body and a bending part, the leaning connection arm is connected to one end of the main body, the bending part is connected between another end of the main body and the moveable elastic arm, and the pivotal connection space is defined as a space formed through the bending part being treated with a bending process.

* * * * *